US007252125B2

(12) United States Patent
Haag

(10) Patent No.: US 7,252,125 B2
(45) Date of Patent: Aug. 7, 2007

(54) PORTABLE WORKDECK

(76) Inventor: Harley J. Haag, 2903 Governor Dr., San Diego, CA (US) 92122

( * ) Notice: Subject to any disclaimer, the term of this patent is extended or adjusted under 35 U.S.C. 154(b) by 11 days.

(21) Appl. No.: 11/087,710

(22) Filed: Mar. 24, 2005

(65) Prior Publication Data

US 2006/0213578 A1 Sep. 28, 2006

(51) Int. Cl.
*B25H 1/14* (2006.01)

(52) U.S. Cl. ..... 144/286.5; 144/287; 108/90; 108/143

(58) Field of Classification Search ..... 144/144.1, 144/144.51, 145.1, 286.1, 286.5, 287; 83/471.2, 83/477.2, 471.1; 108/90, 143, 50.11
See application file for complete search history.

(56) References Cited

U.S. PATENT DOCUMENTS 2,556,943 A * 6/1951 Reisman ..... 108/90
4,133,360 A * 1/1979 Sanfilippo et al. ..... 144/286.1
5,191,935 A * 3/1993 McCombie ..... 144/286.1
6,546,978 B2 * 4/2003 Thoman ..... 144/286.1
6,619,348 B2 * 9/2003 Wang ..... 144/287

* cited by examiner

*Primary Examiner*—Shelley M. Self
(74) *Attorney, Agent, or Firm*—Bacon & Thomas, PLLC

(57) ABSTRACT

A portable workdeck assembly is described as including a specially configured planar work surface on whose upper surface may be mounted a number of distinct bench mounted tools and related accessories, and whose lower surface carries user adjustable means enabling the deck assembly to be interfitted onto a plurality of variously sized and shaped supporting base members. The workdeck assembly therefore readily facilitates the portability of a set of familiar bench mounted tools and accessories to various sites. In a preferred baseline embodiment, one or more rigidifying channels longitudinally disposed on the work surface bottom carry a number of two-axis adjustable feet which enable the workdeck assembly to interfit snugly with variously sized rolling tool cabinets. In an alternate embodiment, a number of cross members with resilient feet are mounted on the work surface bottom enabling the workdeck to be non-slidingly positioned atop any suitably strong horizontally disposed base member.

10 Claims, 3 Drawing Sheets

FIG.1
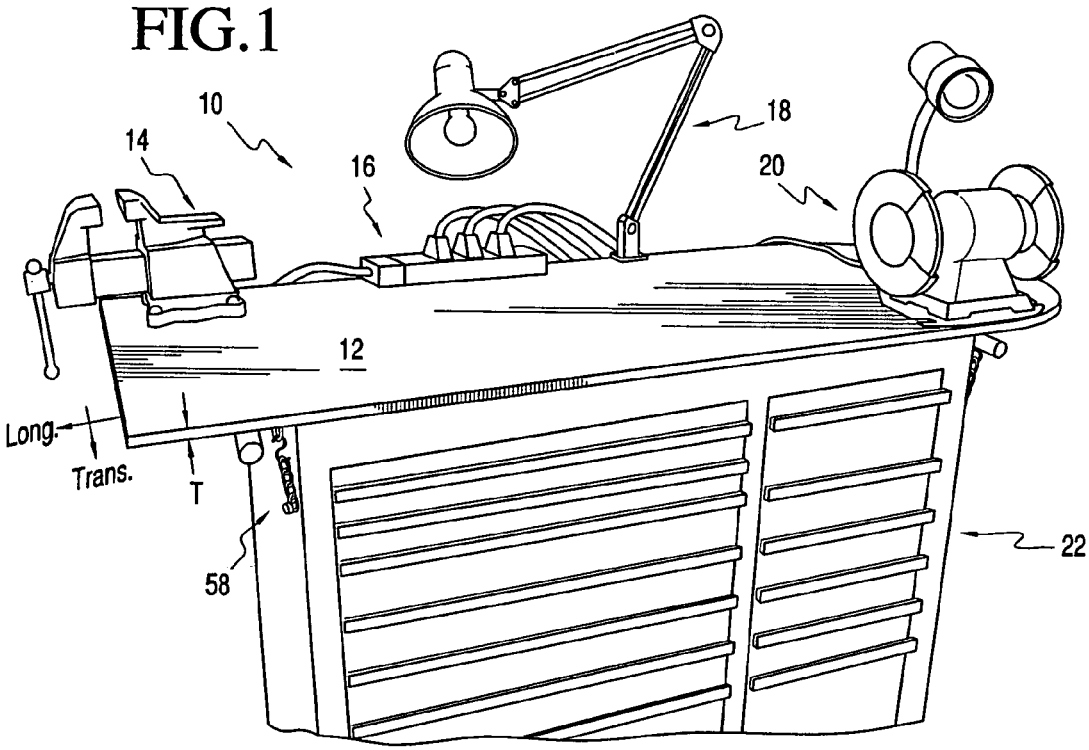
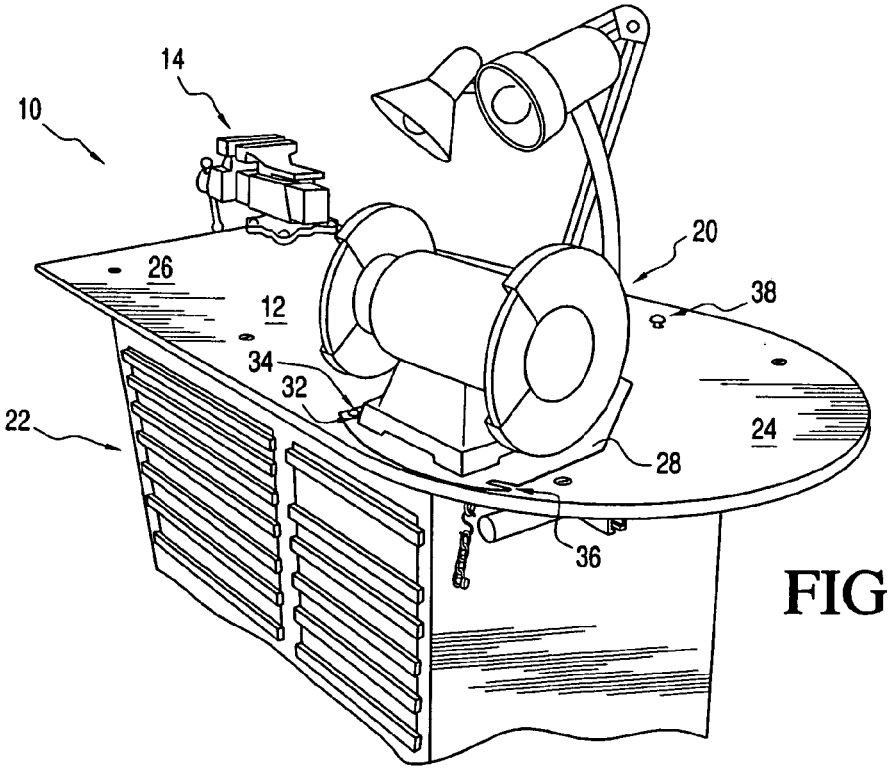
FIG.2

FIG.3
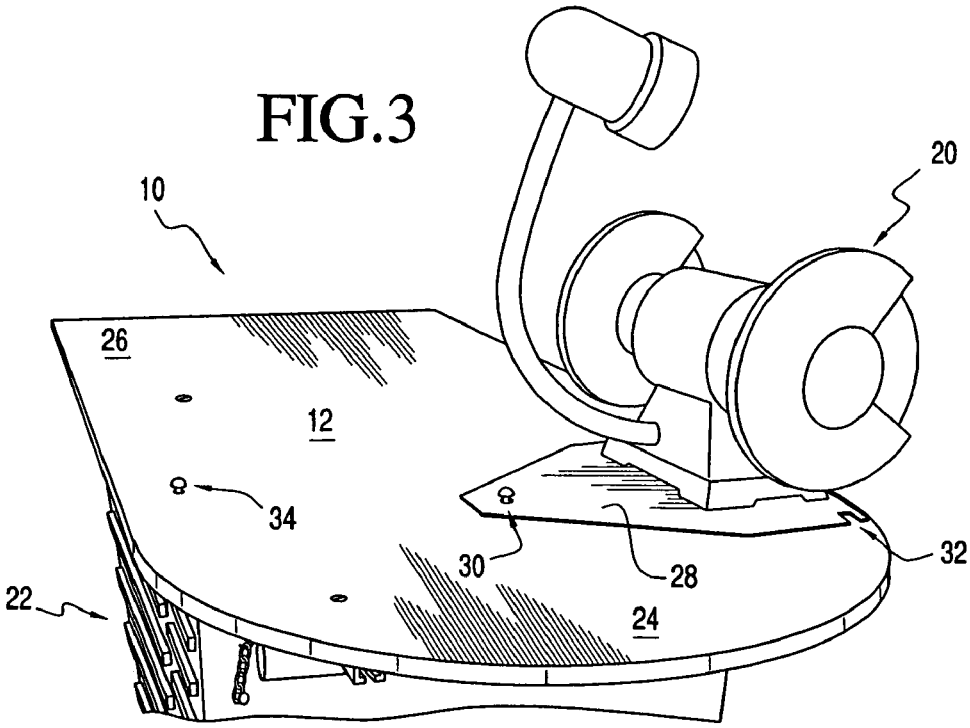
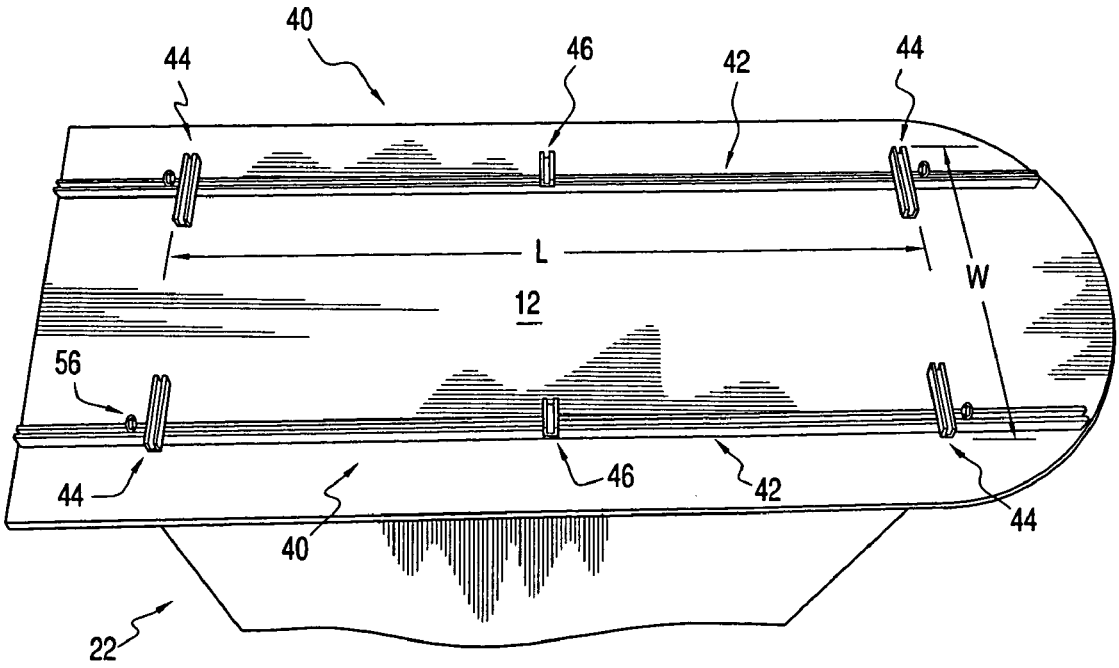
FIG.4

FIG.5
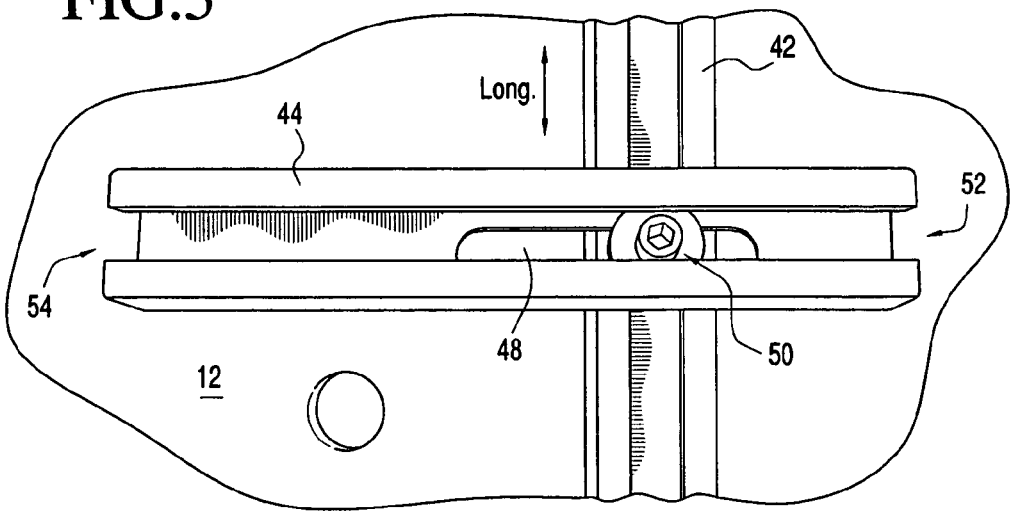
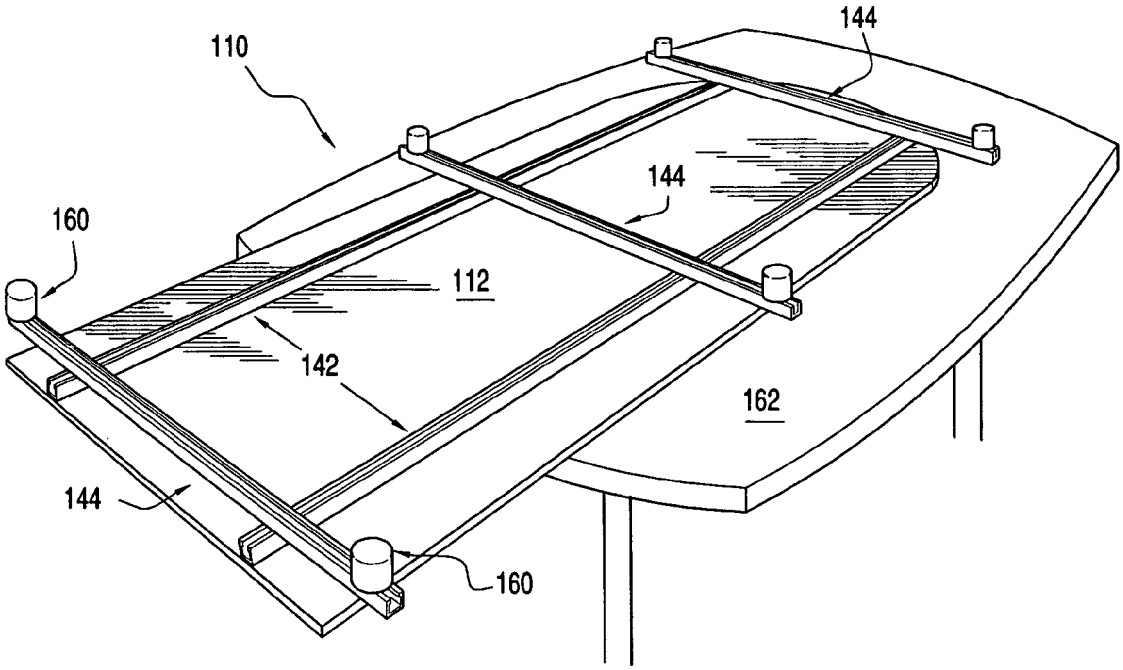
FIG.6

PORTABLE WORKDECK

TECHNICAL FIELD

The present invention relates generally to a portable workdeck assembly for use by mechanics, handymen and hobbyists, and more particularly to a uniquely shaped and configured planar work surface on which a plurality of bench tools and accessories may be mounted and carried from place to place. The work surface is adapted to be interfitted with and supported by a wide variety of base members, thereby affording a user with convenient access to his familiar tools in their usual locations at different work sites.

BACKGROUND

Carpenters, auto mechanics, handymen, home hobbyists and other craftsmen greatly prefer to use familiar work stations that provide quick access to their favorite bench mounted tools to carry out their tasks. Not infrequently, however, it is necessary that they must do their work in different locations, which requires transporting a variety of power tools to various work sites. To overcome the formidable logistics of transporting bench mounted tools and their related accessories to different job sites, many craftsmen instead try to make do with only smaller portable tools. This approach often causes their work to proceed slowly and with less favorable end results. A number of attempts have been made to compensate for the problems associated with transporting bench mounted tools from place to place, but an ideal solution has yet to be found in prior art methods and apparatus.

Descriptions of typical prior art approaches to transporting bench mounted power tools may be found in a number of U.S. patents.

U.S. Pat. No. 5,431,206 to McAllister is illustrative of a large body of prior art showing portable work benches capable of having a plurality of different power tools affixed to its top working surface. However, this patent is directed to portability of the entire multi-tool workstation including a large and cumbersome base support structure.

U.S. Pat. No. 6,688,350 to Heinlen et al. provides a clear showing of the broad idea of having a number of replaceable work tool bench tops that carry various premounted power tools. However, each different top is mounted on the same supporting cabinet as best seen in its FIG. 5 This patent is illustrative of many other U.S. patents that show "single base/many different top" arrangements, which teach directly away from the "single is top/many different base" arrangements of the present invention.

PCT Patent Application No. PCT/EP93/00089 to Ebert provides a clear teaching of the broad concept of designing a flat surfaced table top having anchoring structures called longitudinal ribs formed into its lower surface to mate with different base members. See FIG. 1 wherein the single table top may be mounted on one of three distinct base member arrangements.

Additional teachings of various types of prior art work benches having tools mounted thereon and directed to some form of portability are found in U.S. Pat. No. 5,722,473 to Tucker and in the early (1914) U.S. Pat. No. 1,104,103 to Carpenter, Jr.

While each of these prior art teachings show approaches that function more or less well for its intended purposes, they have not to date provided a portable workdeck suitable for carrying a number of bench mounted tools using a minimal and cost effective amount of needed structures and operational manipulations. It is exactly these needs that the present invention admirably meets.

OBJECTS OF THE INVENTION

It is therefore a primary object of the present invention to provide an improved portable workdeck assembly wherein a single planar work surface, which may carry an array of bench mounted tools and accessories, may readily be mated to and securely supported by a wide variety of base member sizes and shapes.

An additional object of the present invention is to provide a planar work surface having a rounded end whereby at least one of a plurality of bench mounted tools and accessories, which may be carried on a top surface thereon, can be readily and conveniently reoriented and accessed from two or more sides of the work surface.

A further object of the present invention is to provide a planar work surface including one or more bottom mounted rigidifying channels along which a number of moveable support elements are arrayed so as to closely interfit with or rest upon supporting base members of various sizes and types.

A still further object of the present invention is to provide a planar work surface including bottom mounted rigidifying channels along which a number of moveable cross members having resilient feet are positioned so as to support the weight of the work deck assembly on a suitably robust base member having a substantially horizontal top surface.

In baseline and alternate preferred embodiments, a specially shaped portable workdeck assembly is advantageously configured to carry a number of different work bench mounted tools and accessories on its top planar work surface, and an array of rigidifying members carrying two axis positionable feet on its bottom surface. The workdeck assembly includes user adjustable means enabling it to be quickly and securely interfitted with or onto a wide variety of base members using a quasi interference fit approach.

The effort is directed to facilitating the portability of a familiar set of bench mounted tools and accessories for use by auto mechanics, handymen, hobbyists, and the like craftsmen. In a baseline embodiment, the bottom mounted positionable feet—four illustratively—may be adjusted both longitudinally and transversely so as to fit snugly within the upper walls of the top wells of conventional rolling tool cabinets, i.e., the loose or quasi interference fit. An alternate embodiment teaches the use of a number of bottom mounted cross members having positionable resilient feet enabling the workdeck to be positioned atop any base member having a horizontal top surface. In either embodiment, the work surface may include a rounded end to allow a selected tool to be pivoted so as to be accessible from the deck front, rear or side.

BRIEF DESCRIPTION OF THE DRAWINGS

Additional objects and advantages of the invention will become apparent to those skilled in the art as the description proceeds with reference to the accompanying drawings, wherein:

FIG. 1 is a front perspective view of an improved portable workdeck assembly embodying the features described according to the present invention;

FIG. 2 is a perspective view of a baseline embodiment of a planar work surface used in the portable workdeck assembly of FIG. 1;

FIG. 3 is an alternate perspective view of the baseline embodiment of the planar work surface depicted in FIG. 2;

FIG. 4 is a bottom perspective view of the baseline embodiment of the planar work surface depicted in FIG. 2;

FIG. 5 is an enlarged plan view of a moveable foot and its longitudinal and transverse position adjustability along a rigidifying channel member; and FIG. 6 is a bottom perspective view of an alternate embodiment of a portable workdeck assembly according to the present invention having means to support itself on any horizontal planar base surface or member.

BEST MODE FOR CARRYING OUT THE INVENTION

Referring now to FIG. 1, there is shown a perspective view of a baseline preferred embodiment of a portable workdeck assembly according to the present invention. By way of a brief overview, a baseline embodiment of a portable workdeck assembly 10 consists of a planar, horizontally disposed work surface 12 specially configured and shaped to carry a number of permanently mounted tools and related accessories. Illustratively, the portable workdeck 10 may carry a vice 14, a multiple outlet electrical strip 16, an articulated lamp 18 and a reorientable bench grinder 20. Other tools and accessories may also be substituted for or added to this illustrative group, however they do not form an integral part of the present invention. As shown, the portable workdeck 10 is adapted to be mounted on and/or affixed to any of a wide variety of commercially available rolling tool cabinets 22, of the types and brands well known and commonly found in commercial auto garages, and handymen's workshops. As described in detail herein below, the planar work surface 12 further includes rigidifying and interfacing means to facilitate its rapid interfitting/mating with various types and sizes of bases, such as the tool cabinet 22.

In use, the portable workdeck 10 is carried to a desired work site and mounted atop a suitable base such that the user has quick access to his familiar tools and accessories in their regular relative locations to accomplish the task at hand. The work surface 12 may be formed of high density polyethylene (HDPE), polypropylene, or pultruded fiberglass, and the like synthetic materials which have high durability and strength. In a preferred embodiment the work surface 12 may be approximately 60 inches in length (along its longitudinal axis indicated by arrow "LONG."), approximately 22-24 inches deep (along its transverse axis indicated by arrow "TRAN."), and of sufficient thickness "T" to provide a rigid and stable working surface. Typical thicknesses may range between ½ inch for the high strength plastics, and slightly thicker (¾ to 2 inches) for composites or wood products.

With reference now to two perspective views of FIGS. 2 and 3, an important feature concerning the shape of work surface 12 is described. One end of the work surface 12 is rounded in shape as depicted at end 24, while the opposite end may, conventionally, be rectangular as depicted at end 26. This rounded end 24 enables a highly useful capability of the portable workdeck assembly 10, namely allowing the bench grinder 20 to be accessed by a user from the front of the workdeck 10 as shown FIG. 2, or from the rear as shown in FIG. 3. The ability to variably orient the bench grinder 20 while allowing uniformly relative positional access to a workpiece being abraded despite the grinder's orientation is accomplished by means of a unique mounting plate, pivotal point/locking bolt arrangement. The grinder 20 is securely bolted to a rotatable mounting plate 28 which is rotatably affixed to the work surface 12 via a pivot bolt 30 positioned at approximately the work surface's transverse mid point. The plate 28 includes a pair of slots 32/36 located and shaped to mate with a pair of stop/lock bolts 34/38, respectively. In the orientation of FIG. 2, the slot 32 engages stop/lock bolt 34 which is then screwed down to firmly lock the grinder 20 in that position for use. In the alternate orientation of FIG. 3, slot 36 engages stop/lock bolt 38 (hidden in that view) to similarly lock the grinder 20 in that alternate position for use. While not specifically shown, it is clear that intermediate orientations of the grinder 20—such as a 90 degree (or other) rotation in lieu of the 180 degree shown—may be readily implemented merely by providing additional suitably located lock/stop bolts on the work surface 12. Thus, the unique grinder dual (or multiple) orientation capability allows the user to quickly rotate the grinder from the front (per FIG. 2) to the rear (per FIG. 3) of the work surface 12. This feature further provides increased available bench working area along the front of work surface 12 when the grinder is not needed for use and is oriented per FIG. 3.

Referring now to FIG. 4 there is shown a bottom perspective view of the planar work surface 12 depicting the unique means for rigidifying, mating and securing the portable work deck assembly 10 to a wide variety of supporting base members such as, illustratively, the conventional multiple-drawer rolling tool cabinet 22. The planar work surface 12 includes a pair of multipurpose sliding rail support assemblies. These assemblies serve to add longitudinal rigidity to the work surface 12 as well as to provide the means for snugly interfitting the surface 12 to its base member using the quasi interference fit technique previously detailed.

The two sliding rail support assemblies are mirror image identical, only one will be described. A sliding rail support assembly 40 includes a longitudinally disposed, extruded aluminum channel 42 firmly anchored to the bottom of the work surface 12 by any well known fasteners. A pair of moveable support feet 44 are mounted via tightenable bolts (not shown) which allow the moveable feet 44 to be slid longitudinally along the channels 42 to any desired location and then firmly anchored in position. A slightly shorter pair of support feet 46 is similarly affixed to the channels 42 at approximately their longitudinal midpoints, and fixed in position. The support feet 44 and 46 may be fabricated from the same aluminum channel stock as the channels 42. By suitable choice of material type and size, the channels 42 add a high degree of rigidity to the work surface 12. While it is preferred that this rigidifying action be done using the pair of rail supporting assemblies with two distinct channels 42, the present invention also contemplates merging the features of these two channels into a single channel member which has a greater transverse dimension thus functionally substituting for the two channels 42.

Referring briefly to FIG. 5 there is shown an enlarged plan view of a typical moveable foot 44 and its attachment and two-axis adjustment schemes with respect to its associated channel 42. The foot 44 includes an interiorly formed slot 48 through which an adjustment/locking bolt 50 is routed. Upon loosening the bolt 50 the foot 44 may be slid longitudinally (up/down in the figure) to any desired position. Also, the foot 44 may be slid transversely (left/right in the figure) such that the location of its first engaging end 52 may be set within the range permitted by slot 48. By turning the foot 44 by 180 degrees, a somewhat greater transverse distance from the channel 42 may be set as measured to a second engaging end 54.

With reference again to FIGS. 1 and 4, the manner of positively interfitting or mating the portable work deck 10 to a cabinet is detailed with respect to the rolling tool cabinet 22 having an open well at its top. As shown in FIG. 4, properly adjusting the longitudinal locations of the four feet 44 will establish an interior length dimension "L" which is set to be very slightly smaller than the inside dimension (along its long side) of the well on the cabinet 22. Similarly, properly adjusting the transverse location of the four moveable feet 44 will establish an interior width dimension "W" which is set to be slightly smaller than the inside dimension of the cabinet well (along its shorter side). Together, the "L" and "W" dimensions may be considered as nesting dimensions. Having set and locked these two nesting dimensions the work surface 12 (or workdeck assembly 10) is then flipped over and snugly interfitted into its mating cabinet well ready for use. Various securing means may be employed to assure that the work surface 12 remains mated with its associated cabinet 22 even during heavy, abrupt or non-symmetrical vertical loading. A number of pad eyes, of which 56 is typical, may be arrayed along the underside of work surface 12 for engaging with short chain sections, of which 58 is typical, that may be affixed to the tool cabinet side walls. Other well known securing means may readily be employed.

Referring now to FIG. 6 there is shown an alternate preferred embodiment of a portable workdeck assembly 110 having means to support itself on any horizontally disposed base member having a planar upper surface. As with the previous baseline embodiment, a pair of rigidifying channels 142 are firmly affixed to the bottom of the work surface 112 by any well known fasteners. The channels 142 may be formed as extruded aluminum members of sufficient size and cross section to provide the desired high degree of rigidity to the planar work surface 112. The work surface 112 may be fabricated, sized, shaped, drilled and fitted out substantially identically to the work surface 12 previously described. Attached to the pair of channels 142 are a plurality of transverse support members designated cross members 144. Illustratively, three cross members are depicted, more or fewer may be employed as required. The cross members 144 are identical in structure and function, only one will be described. Each cross member 144 is slidably moveable longitudinally along the pair of channels 142 as described in connection with the baseline embodiment of FIG. 4 and thereafter locked in place as previously described. A resilient foot member 160 is moveably affixed to each of the outboard ends of the cross member 144 to provide a non-skid, non-marring interface element for uniformly transferring the weight of the work deck assembly 110 to the horizontal surface of the base supporting it. The resulting array of resilient feet 160 may be transversely positioned as required to best rest on its intended base. As suggested in FIG. 6, the supporting base may be an outdoor coffee table 162, a picnic table, or the like.

Although the invention has been described in terms of preferred and alternate embodiments, the invention should not be deemed limited thereto since other embodiments and modifications will readily occur to one skilled in the art. It is therefore to be understood that the appended claims are intended to cover all such modifications as fall within the true spirit and scope of the invention.

The invention claimed is:

1. A portable workdeck assembly which may carry a plurality of bench mounted tools and related accessories thereon for use at one or more distinct locations comprising:

(a) a planar work surface having longitudinal and transverse axes adapted to receive said plurality of tools and related accessories mounted on atop surface thereof;

(b) one or more dual purpose channel members fixedly mounted on a bottom surface of said planar work surface, said channel members including at least one rigidifying rail longitudinally disposed along said bottom surface;

(c) said one or more channel members further including a plurality of moveable interface members transversely disposed along said at least one rigidifying rail, each of said moveable interface members adapted to be slidingly moveable in a longitudinal direction along said at least one rigidifying rail so as to establish a desired longitudinal dimension between the outboard edges of a selected pair of said moveable interface members;

(d) each of said moveable interface members adapted to be slidingly moveable in a transverse direction along said at least one rigidifying rail so as to establish a desired transverse dimension between the outboard edges of a selected pair of said interface members; and (e) whereby upon establishing said desired longitudinal and transverse dimensions and fixing the position of said interface members, said portable workdeck assembly may be securely mated with variously sized base members.

2. The portable workdeck assembly of claim 1 wherein said interface members include at least two cross members adapted for longitudinal movement along said at least one rigidifying rail and a plurality of resilient feet adapted for transverse movement along said cross members.

3. The portable workdeck assembly of claim 2 wherein said at least one rigidifying rail is a pair of rigidifying rails fixedly mounted parallel to each other and to the outer transverse edges of said planar work surface.

4. The portable workdeck of claim 3 wherein said at least two cross members are three cross members each carrying at least two resilient feet whereby said securely mating with various sized base members is done via at least six resilient feet.

5. A portable workdeck assembly which may carry a plurality of bench mounted tools or accessories thereon for use at one or more distinct locations comprising:

(a) a planar work surface having longitudinal and transverse axes adapted to receive said plurality of tools or accessories mounted on a top surface thereof;

(b) one or more dual purpose channel members fixedly mounted on a bottom surface of said planar work surface, said channel members including at least one rigidifying rail longitudinally disposed along said bottom surface;

(c) said channel member further including a plurality of moveable foot members transversely disposed along said at least one rigidifying rail, said moveable feet adapted to be slidingly moveable in a longitudinal direction along said at least one rigidifying rail so as to establish a nesting longitudinal dimension between the outboard edges of a selected pair of said moveable feet;

(d) said moveable feet adapted to be slidingly moveable in a transverse direction along said at least one rigidifying rail so as to establish a nesting transverse dimension between the outboard edges of a selected pair of said moveable feet; and (e) whereby upon establishing said nesting longitudinal and transverse dimensions and fixing the position of said moveable feet to provide a loose interference fit, said portable work deck assembly may be securely interfitted with variously sized base members.

6. The portable workdeck assembly of claim 5 wherein said one or more channel members is a pair of channel members fixedly mounted parallel to each other and to the outer transverse edges of said planar work surface.

7. The portable workdeck assembly of claim 6 wherein said plurality of moveable feet is two pairs of moveable feet, a first pair of said moveable feet slidingly carried by a first one of said pair of channel members and a second pair of said moveable feet carried by a second of said pair of channel members.

8. The portable workdeck assembly of claim 5 wherein said at least one rigidifying rail and said moveable foot members are formed of extruded aluminum channel material.

9. The portable workdeck assembly of claim 5 wherein said planar work surface is formed of synthetic material selected from the group including high density polyethylene and polypropylene and pultruded fiberglass and composite wood products.

10. The portable workdeck assembly of claim 5 wherein said planar work surface is shaped to have a circular profile in plan view at at least one of its longitudinal ends thereby allowing uniformly relative positional access to a workpiece being worked on by a tool which may be mounted proximate said circular end.

* * * * *